US006043199A

United States Patent [19]

Godici

[11] Patent Number: 6,043,199

[45] Date of Patent: Mar. 28, 2000

[54] CORROSION INHIBITING ADDITIVE COMBINATION FOR TURBINE OILS

[75] Inventor: Patrick Edward Godici, Millington, N.J.

[73] Assignee: Exxon Research and Engineering Co., Florham park, N.J.

[21] Appl. No.: 09/192,038

[22] Filed: Nov. 13, 1998

Related U.S. Application Data

[63] Continuation-in-part of application No. 08/918,827, Aug. 26, 1997, abandoned.

[51] Int. Cl.[7] ..... C10M 141/06

[52] U.S. Cl. ..... 508/285; 508/293; 508/295; 508/497; 508/498; 508/506

[58] Field of Search ..... 508/285, 293, 508/295, 497, 498, 506

[56] References Cited

U.S. PATENT DOCUMENTS

| | | | |
|---|---|---|---|
| 2,644,793 | 7/1953 | Rudel et al. | 252/48.6 |
| 2,794,782 | 6/1957 | Cunningham et al. | 252/51.5 |
| 2,809,160 | 10/1957 | Stewart et al. | 252/33.4 |
| 2,841,555 | 7/1958 | Lyons et al. | 252/33.6 |
| 3,048,542 | 8/1962 | Tierney et al. | 252/47.5 |
| 3,223,636 | 12/1965 | Metro et al. | 252/56 |
| 3,245,909 | 4/1966 | Lowe | 252/51.5 |
| 3,245,910 | 4/1966 | Lowe | 252/51.5 |
| 3,280,034 | 10/1966 | Anzenberger et al. | 252/51.5 |
| 3,282,836 | 11/1966 | Miller et al. | 252/34.7 |
| 3,312,619 | 4/1967 | Vineyard | 252/47.5 |
| 3,415,750 | 12/1968 | Anzenberger | 252/51.5 |
| 3,585,137 | 6/1971 | Bosniack et al. | 252/32.5 |
| 3,719,600 | 3/1973 | Bosniack et al. | 252/56 S |
| 3,790,478 | 2/1974 | Rudston et al. | 252/34 |
| 3,790,481 | 2/1974 | Byford et al. | 252/49.9 |
| 3,912,640 | 10/1975 | Anzenberger, Sr. | 252/47.5 |
| 4,101,429 | 7/1978 | Birke | 252/37.7 |
| 5,225,094 | 7/1993 | Pillon et al. | 252/51.5 R |
| 5,227,082 | 7/1993 | Pillon et al. | 252/50 |
| 5,397,487 | 3/1995 | Pillon et al. | 252/51.5 R |
| 5,599,779 | 2/1997 | Karol et al. | 508/283 |
| 5,681,506 | 10/1997 | Pragnell et al. | 252/405 |

FOREIGN PATENT DOCUMENTS

| | | | |
|---|---|---|---|
| 0359071 | 3/1990 | European Pat. Off. | C10M 169/04 |
| 1 420 824 | 1/1976 | United Kingdom . | |
| 93/12210 | 6/1993 | WIPO . | |
| 94/10270 | 5/1994 | WIPO . | |
| 95/29214 | 11/1995 | WIPO . | |

*Primary Examiner*—Jerry D. Johnson

[57] ABSTRACT

Turbine oils of improved corrosion resistance comprise a synthetic ester base stock and additives comprising a combination of a dibasic carboxylic acid and a second component selected from alkyl or alkenyl succinic acid/anhydride ester or hemi-linear or branched ester and hydroxylated derivatives of such esters or hemi esters, and linear or branched alkyl or alkenyl substituted succinimide or amino substituted succinimide.

6 Claims, No Drawings

CORROSION INHIBITING ADDITIVE COMBINATION FOR TURBINE OILS

This application is a Continuation-In-Part of U.S. Ser. No. 08/918,827 filed Aug. 26, 1997 now abandoned.

BACKGROUND OF THE INVENTION

The present invention relates to turbine oils, particularly aviation turbine oils containing additives exhibiting enhanced corrosion resistance.

RELATED ART

While the use of polyol ester base stocks produces turbine lubricating oils which possess outstanding thermal stability, a satisfactory level of oxidation stability and corrosion resistance can be achieved only by the use of additives.

To this end, a wide assortment of different additives have been proposed and utilized.

U.S. Pat. No. 3,790,478 describes a lubricant for aviation turbines comprising hindered esters as base stock and containing alkylated diphenyl amines, and an alkylated phenyl naphthylamine as anti oxidants, a copper passivator, dispersant polymers and a neutral organic phosphate as load carrying additive. The lubricant may also contain hydrolytic stabilizers and lead corrosion inhibitors, e.g., a $C_1$–$C_{20}$ alkyl gallate, neopentyl glycol disebacate, sebacic acid or quinizarin.

U.S. Pat. No. 3,790,481 is similar to U.S. Pat. No. 3,790,478 in being directed to an aviation turbine oil and also recites the presence of lead corrosion inhibitors selected from the group consisting of $C_1$–$C_{20}$ alkyl gallate, neopentyl glycol, disebacate, sebacic acid, and quinizarin.

U.S. Pat. No. 3,585,137 is directed to a synthetic ester aviation turbine oil containing an anthranilamide type metal passivator, antioxidants, phosphate esters, dimer acids. A formulation is disclosed containing p,p'dioctyldiphenylamine, phenothiazine, sebacic acid, benzotriazole, a mixture of phosphate esters and, in other examples, various other additive ingredient. In all cases, however, sebacie acid is indicated as present in the formulation.

U.S. Pat. No. 3,912,640 teaches a gas turbine lubricant comprising a base stock of a blend of carboxylate ester and low viscosity mineral oil and various additives including anti oxidants such as phenothiazines or derivatives thereof and secondary diaryl amines. Methylene linked hindered bisphenol may be substituted for a portion of the phenothiazine material. Additional additives present in the examples include benzotriazole, sebacic acid, tricresyl phosphate. Benzotriazole, tolyltriazole, N,N'-disalicylidene dialkyl amines and sebacic acid are identified as well known metal deactivators. They can be present in the formulations in amounts of from about 0.005 to about 1.0 wt %. See also GB 1,420,824.

WO 95/29214 discloses a synthetic ester based lubricant for helicopter transmissions comprising a synthetic ester base stock, an antioxidant, a neutral organic phosphate, a dicarboxylic acid component, a monocarboxylic acid component, a triazole and a phosphorus containing extreme pressure additive.

WO 94/10270 discloses a synthetic ester based aviation turbine oil containing saturated or unsaturated dicarboxylic acids, e.g., sebacic acid, in combination with a triazole derivative and specified monocarboxylic acids or an ester thereof The combination is reported as being particularly effective in inhibiting corrosion.

U.S. Pat. No. 5,397,487 is directed to lubricating oils having enhanced rust inhibitor capability containing a minor synergistic rust inhibiting amount of a combination of two additives, the first being a material of the Mobilad C 603 type, reported in the '487 patent as being a succinic anhydride amine derivative of the formula:

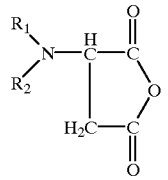

where $R_1$ and $R_2$ are each independently alkyl or alkenyl of from 1 to 20 carbons, and a second material of the Lubrizol LZ 859 type, reported in U.S. Pat. No. 5,397,487 as being a mixture of about 74.5 wt % unreacted tetrapropenyl succinic acid of the formula

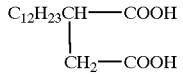

and about 25.5 wt % of a partially esterified tetrapropenyl succinic acid of the formula

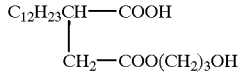

The patents recite that the lubricant can be natural oil or synthetic oil based, synthetic oils including synthetic ester. The lubricants are described as useful in automotive applications, e.g., engine oils, transmission oils, aviation piston engines, turbines and the like. The lubricant can contain other additives which include dispersants, anti-wear agents, anti-oxidants, corrosion inhibitors, detergents, pour point depressants, extreme pressure additives, viscosity index improvers, friction modifiers and the like. Specifics of these other additives were not provided and there were no examples presented employing such other additives.

U.S. Pat. No. 5,225,094 is directed to enhancing the rust inhibition capability of a lubricating oil having an average ring number per mole of less than 1.5 by the addition thereto of at least about 0.06 wt % of an oil soluble rust inhibitor which is a succinic anhydride amine. Data in the patent shows that for the base oil tested, which was a slack wax isomerate, an additive such as LZ 859 (as described in U.S. Pat. No. 5,397,4987, above) was ineffective in preventing rust.

U.S. Pat. No. 5,227,082 is directed to a lubricating oil of enhanced rust resistance comprising a lube oil base stock and a synergistic mixture of (1) a rust inhibiting amount of a rust inhibitor comprising a succinic acid derivative and a partially esterified alkyl succinic acid and (2) a pyridine derivative wherein the weight ratio of (2) to (1) is greater than zero and less than about 0.06.

U.S. Pat. No. 5,599,779 is directed to a synergistic rust inhibiting composition consisting of (a) N-acylsarcosine compound, (b) dicarboxylic acid having 6 to 48 carbon atoms and (c) an amine selected from primary, secondary or tertiary amines or imidazoline compounds. The primary, secondary, or tertiary amine is described as being one selected from the group of compounds of the formula:

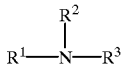

wherein $R^1$, $R^2$, $R^3$ are independently selected from hydrogen, alkyl having up to 14 carbons, hydroxyalkyl, cycloalkyl, or polyalkyleneoxy groups.

It would be highly desirable if the corrosion inhibiting performance of synthetic ester based aviation turbine oils could be improved employing a combination of readily available additives.

DESCRIPTION OF THE INVENTION

The present invention is a synthetic ester based turbine oil of enhanced corrosion inhibiting capacity comprising a major amount of a synthetic ester oil base stock and a minor amount of a corrosion inhibiting additive comprising a combination of as a first component one or more dicarboxylic acids such as sebacic acid, azelaic acid, dioleic acid (known as dimer acids) and a second component selected from (a) linear or branched alkyl or alkenyl succinic acid/anhydride ester or hemi ester or hydroxylated derivatives of such esters or hemi esters, or (b) linear or branched alkyl or alkenyl substituted succinimides or amino substituted succinimides. The formulation containing the combination employing component (a) being marked by the absence of pyridene derivatives of the formula

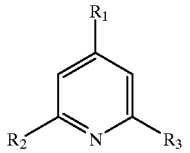

wherein $R_1$, $R_2$, $R_3$ are independently an alkyl group containing from 1 to 3 carbon atoms, preferably marked by the absence of any pyridene or derivative of pyridene.

The diesters that can be used as base oils for the improved turbo oil of the present invention are formed by esterification of linear or branched $C_6$–$C_{15}$ aliphatic alcohols with one of such dibasic acids as adipic, sebacic, or azelaic acids. Examples of diesters are di-2-ethylhexyl sebacate and dioctyl adipate.

The synthetic polyol ester which can be used as the base oil is formed by the esterification of an aliphatic polyol with carboxylic acid. The aliphatic polyol contains from 4 to 15 carbon atoms and has from 2 to 8 esterifiable hydroxyl groups. Examples of polyol are trimethylolpropane, pentaeiythritol, dipentaerytlritol, neopentyl glycol, tripentaeiytritol and mixtures thereof.

The carboxylic acid reactant used to produce the synthetic polyol ester base oil is selected from aliphatic monocarboxylic acid or a mixture of aliphatic monocarboxylic acid and aliphatic dicarboxylic acid. The carboxylic acid contains from 4 to 12 carbon atoms and includes the straight and branched chain aliphatic acids, and mixtures of monocarboxylic acids may be used.

The preferred polyol ester base oil is one prepared from technical pentaerythritol and a mixture of $C_4$–$C_{12}$ carboxylic acids. Technical penta- erythfritol is a mixture which includes about 85 to 92% monopentaetydiritol and 8 to 15% dipentaerythritol. A typical commercial technical pentaerydiritol contains about 88% monopentaerythritol having the formula

I

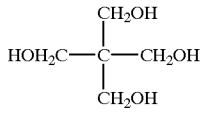

and about 12% of dipentaetythutol having the formula

II

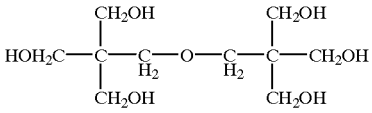

The technical pentaetytlritol may also contain some tri and tetra pentaeiythiitol that is normally formed as by-products during the manufacture of technical pentaetydiritol.

The preparation of esters from alcohols and carboxylic acids can be accomplished using conventional methods and techniques known and familiar to those skilled in the art. In general, technical pentaerytliritol is heated with the desired carboxylic acid mixture optionally in the presence of a catalyst.

Generally, a slight excess of acid is employed to force the reaction to completion. Water is removed during the reaction and any excess acid is then stripped from the reaction mixture. The esters of technical pentaerythritol may be used without further purification or may be further purified using conventional techniques such as distillation.

For the purposes of this specification and the following claims, the term "technical pentaerytritol ester" is understood as meaning the polyol ester base oil prepared from technical pentaerytiritol and a mixture of $C_4$–$C_{12}$ carboxylic acids.

The dibasic carboxylic acid comprising one component of the combination additive added to the base stock to enhance the corrosion inhibiting performance of the lubricant is a $C_6$ to $C_{40}$ total carbon number dicarboxylic acid or mixture of such acids, preferably a $C_6$ to $C_{36}$ dicarboxylic acid, more preferably $C_6$ to $C_{14}$ dicarboylic acid or mixture thereof. The dicarboxylic acids can be any n-alkyl, branched alkyl, aryl, or alkyl substituted aryl dicarboxylic acid or mixture thereof having a total number of carbons within the above recited ranges. Preferred dicarboxylic acids are selected from the group consisting of the commercially available di-oleic acids known as "dimer acids", sebacic acid, azelaic acid and mixtures thereof. These acids are added to the turbo oil formulations in an amount in the range of 100 to 1000 ppm, preferably 200 to 500 ppm, more preferably 200 to 400 ppm.

The second component of the corrosion inhibiting additive combination is (a) linear or branched alkyl or alkenyl succinic acid/anhydride ester or hemi ester or hydroxylated derivatives of such esters or hemi-ester, said material having the structural formula:

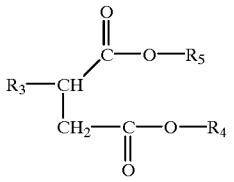

wherein $R_3$ is a $C_8$–$C_{16}$ linear or branched alkyl or alkenyl, $R_4$ and $R_5$ are or different and are hydrogen, $C_1$–$C_4$ alkyl or $C_2$–$C_4$ alkenyl or

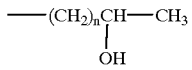

where n can be an integer from zero to 5, preferably $R_3$ is $C_{10-12}$ branched alkenyl, $R_4$ is H and $R_5$ is

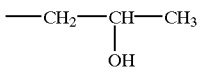

and n and m are each 1, (commercial materials such as Lubrizol 859 from the Lubrizol Corporation or Parabar 302 from Exxon Chemical Company being representative of such materials) or (b) reaction product of linear or branched alkyl or alkenyl substituted succinic anhydride with substituted amino-imidazolines resulting in what are believed to be linear or branched alkyl or alkenyl substituted succininide or amine substituted succinimides, which are believed to be of the structural formula:

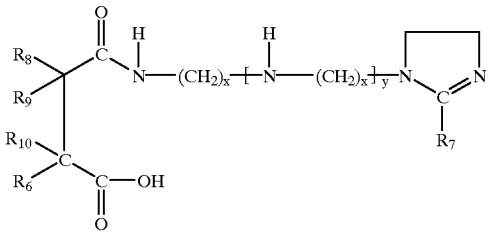

and

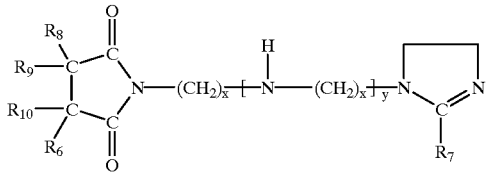

and mixtures thereof, wherein $R_6$, $R_8$, $R_9$ and $R_{10}$ are the same or different and are H or a $C_1$–$C_{16}$, linear or branched alkyl or alkenyl wherein at least one of $R_6$, $R_8$, $R_9$ or $R_{10}$ is hydrocarbyl, preferably at least one of $R_6$, $R_8$, $R_9$ or $R_{10}$ is a $C_{10}$–$C_{14}$ hydrocarbyl, more preferably a $C_{12}$ hydrocarbyl, e.g., tetra propenyl, and $R_7$ is $C_8$–$C_{20}$, preferably $C_{16}$–$C_{18}$, linear or branched alkyl or alkenyl and x is 2 to 10, preferably 2 and y is 0 or 1, preferably 0. Commercially available material known as Mobilad C-603 from Mobil Chemical Company and Hitec 536 from Ethyl are believed to be examples of such materials.

This second component is added to the turbo oil formulation in an amount in the range 100 to 1000 ppm, preferably 300 to 1000 ppm, more preferably 300 to 500 ppm.

When the combination which is employed is the combination of one or more dicarboxylic acids and a second component selected from linear or branched alkyl or alkenyl succinic acid/anhydride ester or hemi ester or hydroxylated derivatives of such esters or hemi esters the combination is employed in the turbine oil in the absence of any pyridine derivative(s) of the formula

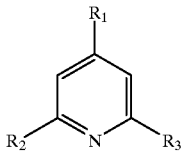

wherein $R_1$, $R_2$, $R_3$ are independently an alkyl group containing from 1 to 3 carbon atoms.

The turbine oil of the present invention may also contain any of the other, typical additives which are usually or preferably present in such fully formulated products except where as it has been otherwise indicated above. Thus, a fully formulated turbine oil may contain one or more of the following classes of additives: antioxidants, antiwear agents, extreme pressure additives, antifoamants, detergents, hydrolytic stabilizers, metal deactivators, other rust inhibitors, etc. Total amounts of such other additives can be in the range 0.5 to 15 wt % preferably 2 to 10 wt %, most preferably 3 to 8 wt %.

Antioxidants which can be used include aryl amines, e.g. phenylnaphthylamines and dialkyl diphenyl amines and mixtures thereof, hindered phenols, phenothiazines, and their derivatives.

The antioxidants are typically used in an amount in the range 1 to 5 wt %.

Antiwear/extreme pressure additives include hydrocarbyl phosphate esters, particularly trihydrocarbyl phosphate esters in which the hydrocarbyl radical is an aryl or alkaryl radical or mixture thereof. Particular antiwear/extreme pressure additives include tricresyl phosphate, triaryl phosphate and mixtures thereof. Other or additional anti wear/extreme pressure additives may also be used.

The antiwear/extreme pressure additives are typically used in an amount in the range 0 to 4 wt %, preferably 1 to 3 wt %.

Industry standard corrosive inhibitors may also be included in the turbo oil. Such known corrosion inhibitors include the various triazols, for example, tolyltriazol, 1,2,4 benzotriazol, 1,2,3 benzotriazol, carboxy benzotriazole, allylated benzotriazol.

The standard corrosion inhibitor additive can be used in an amount in the range 0.02 to 0.5 wt %, preferably 0.05 to 0.25 wt %.

Other rust inhibitors common to the industry include the various hydrocarbyl amine phosphates and/or amine phosphates.

As previously indicated, other additives can also be employed including hydrolytic stabilizers pour point depressants, anti foaming agents, viscosity and viscosity index improver, etc.

The invention is further described by reference to the following non-limiting examples and comparative examples.

Base Formulation 1 is a Tech-PE polyol ester additized with tricresylphosphate, arylamine antioxidants, benzotriazole derivative copper deactivator, amine phosphate and alkyl amine components. To this base formulation individual corrosion inhibitors were added and D665A rust results were obtained as shown in Table 1. Values reported are percent rust in the D665A rust test. A passing result requires that no rust be present.

Additive combination of sebacic acid with alternatively Hitec 536, Mobilad-C603 or Parabar 302 are reported in Table 2. At lower concentrations the additive combinations show improvement over the base case in Table 1. With the combination of 200 ppm sebacic acid and 300 ppm of the other corrosion inhibitor, passing results are obtained which are not achievable via a single corrosion inhibitor. It is desirable to limit the concentration of dicarboxylic acid component because higher levels of acidity can catalyze polyol ester hydrolysis. By using the combination of corrosion inhibitors total acidity is reduced while anti-corrosion performance equal to or exceeding that achieved with high concentrations of acid are obtained.

Table 3 shows additive combinations in Base Formulation 2. Base Formulation 2 differs from Base Formulation 1 only in that the antioxidant treat rate is somewhat higher. Again combination of corrosion inhibitors at certain concentrations are more effective than either inhibitor used alone.

Table 4 gives the base line results for single corrosion inhibitors in base Formulation 3. Base Formulation 3 is similar to Base Formulation 2 except that an alternate antioxidant is substituted at the same treat rate. Sebacic acid is much more efficient alone than the longer chain dicarboxylic acid Empol 1022, a mixture of dimers and trimers of $C_{18}$ unsaturated dicarboxylic fatty acids.

Table 5 provides results for Base Formulation 3 with a combination of corrosion inhibitors. Passing results are achieved for 400 ppm sebacic acid with 1000 ppm of the second corrosion inhibitor.

TABLE 1

BASE FORMULATION #1
PLUS ONE CORROSION INHIBITOR

| AVERAGE | CONCENTRATION, ppm | | | |
|---|---|---|---|---|
| D665 - % Rust | Sebacic Acid | Hitec 536 | Mobilad-C603 | PAR-302 |
| 73 | — | | | |
| 50 | 50 | | | |
| 16 | 100 | | | |
| 18 | 200 | | | |
| 2 | 500 | | | |
| 90 | | 50 | | |
| 65 | | | 50 | |
| 45 | | | | 50 |
| 80 | | 100 | | |
| 80 | | | 100 | |
| 75 | | | | 100 |
| 80 | | 200 | | |
| 70 | | | 200 | |
| 45 | | | | 200 |
| 20 | | 500 | | |
| 10 | | | 500 | |
| 25 | | | | 500 |

TABLE 2

BASE FORMULATION #1
PLUS COMBINATION OF CORROSION INHIBITORS

| AVERAGE | CONCENTRATION, ppm | | | |
|---|---|---|---|---|
| D665 - % Rust | Sebacic Acid | Hitec 536 | Mobilad-C603 | PAR-302 |
| 60 | 50 | 50 | | |
| 90 | 50 | | 50 | |
| 70 | 50 | | | 50 |
| 50 | 100 | 100 | | |
| 30 | 100 | | 100 | |
| 15 | 100 | | | 100 |
| 5 | 200 | 200 | | |
| 1 | 200 | 300 | | |
| Pass | 200 | | 300 | |
| Pass | 200 | | | 300 |
| 7 | 300 | 100 | | |

TABLE 2-continued

BASE FORMULATION #1
PLUS COMBINATION OF CORROSION INHIBITORS

| AVERAGE | CONCENTRATION, ppm | | | |
|---|---|---|---|---|
| D665 - % Rust | Sebacic Acid | Hitec 536 | Mobilad-C603 | PAR-302 |
| 5 | 300 | 200 | | |
| 3 | 300 | 300 | | |
| 13 | 100 | 200 | | |
| 10 | 100 | 300 | | |
| 5 | 200 | 200 | | |
| 35 | 100 | 100 | | |
| 12 | 150 | 150 | | |

TABLE 3

BASE FORMULATION #2
PLUS COMBINATION OF CORROSION INHIBITORS

| AVERAGE | CONCENTRATION, ppm | | |
|---|---|---|---|
| D665 - % Rust | Sebacic Acid | Hitec 536 | Mobilad-C603 |
| 5 | 50 | 100 | |
| 6 | 50 | 200 | |
| Pass | 50 | 300 | |
| Pass | 50 | 500 | |
| Pass | 400 | 300 | |
| Pass | 400 | 500 | |
| 5 | 200 | | 300 |
| 1 | 400 | | 300 |

TABLE 4

BASE FORMULATION #3
PLUS ONE CORROSION INHIBITOR

| AVERAGE | CONCENTRATION, ppm | | | |
|---|---|---|---|---|
| D665 - % Rust | Sebacic Acid | Empol 1022 | H-536 | Mobilad C603 |
| 50 | (None) | | | |
| 60 | | 100 | | |
| 65 | | 200 | | |
| 50 | | 500 | | |
| 45 | | 1000 | | |
| 15 | 100 | | | |
| 3 | 200 | | | |
| 1 | 500 | | | |
| 1 | 1000 | | | |
| 40 | | | 300 | |
| 10 | | | 500 | |
| 35 | | | | 300 |
| 7 | | | | 500 |
| 1 | | | 1000 | |
| 1 | | | | 1000 |

TABLE 5

BASE FORMULATION #3
PLUS COMBINATION OF CORROSION INHIBITORS

| AVERAGE | CONCENTRATION, ppm | | | |
|---|---|---|---|---|
| D65 - % Rust | Sebacic Acid | H-536 | Mobilad C603 | PAR-302 |
| 30 | 200 | 100 | | |
| 1 | 200 | 500 | | |
| 1 | 400 | 500 | | |
| 10 | 200 | | 100 | |
| 2 | 200 | | 300 | |

TABLE 5-continued

| BASE FORMULATION #3 PLUS COMBINATION OF CORROSION INHIBITORS | | | | |
|---|---|---|---|---|
| AVERAGE | CONCENTRATION, ppm | | | |
| D65 - % Rust | Sebacic Acid | H-536 | Mobilad C603 | PAR-302 |
| 1 | 200 | | 500 | |
| 5 | 400 | | 100 | |
| 2 | 400 | | 300 | |
| 1 | 400 | | 500 | |
| 15 | 200 | | | 100 |
| 1 | 200 | | | 300 |
| 5 | 200 | | | 500 |
| 1 | 400 | | | 100 |
| 1 | 400 | | | 300 |
| 1 | 400 | | | 500 |
| 10 | 200 | 300 | | |
| 7 | 400 | 500 | | |
| 1 | 600 | 500 | | |
| B/L | 600 | 1000 | | |
| Pass | 400 | 1000 | | |
| 1 | 600 | | 500 | |
| Pass | 600 | | 1000 | |
| 3 | 400 | | 500 | |
| Pass | 400 | | 1000 | |

When considering the data in these Tables, one needs to bear several factors in mind. Rust tests are highly variable. Thus, for those skilled in the art, it is the trend in rust results with increasing additive concentration which is most important. When all of the data are examined, it is clear that none of the additives alone are able to provide passing results. Combinations of rust inhibitors, however, are able to achieve passing results at concentration levels which do not have harmful secondary effects.

Even when the test results are not a pass, the combination of rust inhibitors provides an improved rust rating than either additive alone. This trend clearly indicates a synergistic interaction of the combined corrosion inhibitors.

What is claimed is:

1. A turbine oil composition exhibiting enhanced corrosion inhibiting capacity comprising a major amount of a synthetic ester oil base stock and a minor amount of corrosion inhibiting additive, said corrosion inhibiting additive comprising a combination of as a first component one or more $C_6$–$C_{40}$ dicarboxylic acids, present in an amount in the range of 100 to 1000 ppm, and a second component selected from (a) linear or branched alkyl or alkenyl succinic acid/anhydride ester or hemi ester or hydroxylated derivative of such esters or hemi esters and (b) linear or branched alkyl or alkenyl substituted succinimides or succinamides or mixtures thereof or amino-substituted succinimides, or succinamides or mixtures thereof wherein said succinimides, succinamides or mixtures thereof is HITEC 536, MOBILAD C-603 or mixture thereof, the turbine oil containing the aforesaid combination employing component (a) being marked by the absence of any pyridine derivatives of the formula

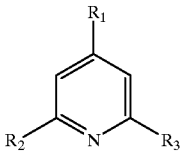

wherein $R_1$, $R_2$, $R_3$ are individually an alkyl group containing from 1 to 3 carbon atoms.

2. A turbine oil composition exhibiting enhanced corrosion inhibiting capacity comprising a major amount of a synthetic ester oil base stock and a minor amount of a corrosion inhibiting additive, said corrosion inhibiting additive comprising a combination of as a first component one or more $C_6$–$C_{40}$ dicarboxylic acids, present in an amount in the range of 100 to 1000 ppm, and a second component selected from (a) linear or branched alkyl or alkenyl succinic acid/anhydride ester or hemi ester or hydroxylated derivative of such ester or hemi ester of the formula:

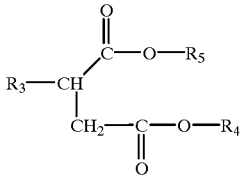

where $R_3$ is a $C_8$–$C_{16}$ linear or branched alkyl or alkenyl, $R_4$ and $R_5$ are different and are hydrogen, $C_1$–$C_4$ alkyl, $C_2$–$C_4$ alkenyl or:

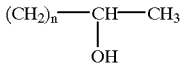

where n can be an integer from zero to five;

(b) linear or branched alkyl or alkenyl substituted succinimide, or succinamide or amine substituted succinimide, or succinamide of the formula:

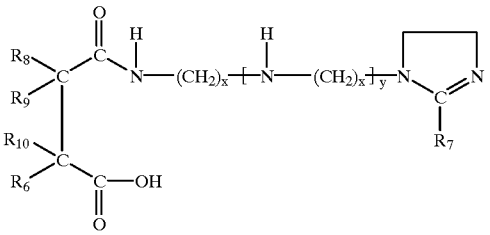

or

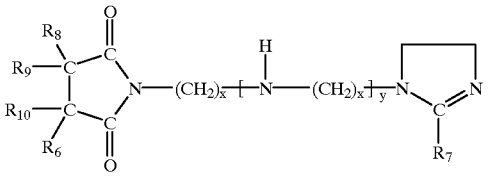

and mixture hereof wherein $R_6$, $R_8$, $R_9$, and $R_{10}$ are the same or different and are H or a $C_1$–$C_{16}$ linear a branched alkyl or alkenyl wherein at least one of $R_6$, $R_8$, $R_9$, and $R_{10}$ is hydrocarbyl, and $R_7$ is $C_8$–$C_{20}$ linear or branched alkyl or alkenyl, x is 2 to 10 and y is 0 or 1, said second component being present in the turbine oil composition in an amount in the range of 100 to 1000 ppm, the turbine oil containing the aforesaid combination employing component (a) being marked by the absence of any pyridine derivatives of the formula

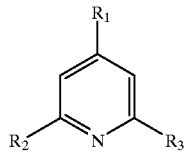

wherein $R_1$, $R_2$ and $R_3$ are individually an alkyl group containing from 1 to 3 carbon atoms.

3. The turbine oil composition of claim 1 or 2 wherein the dicarboxylic acid is selected from dioleic acid, sebacic acid, azelaic acid and mixtures thereof.

4. A method for enhancing the corrosion inhibiting capacity of turbine oil composition comprising adding to a synthetic ester oil base stock a minor amount of corrosion inhibiting additive wherein said corrosion inhibiting additive comprises a combination of as a first component one or more $C_6$–$C_{40}$ dicarboxylic acid, in an amount in the range of 100 to 1000 ppm, and a second component selected from (a) linear or branched alkyl or alkenyl succinic acid/anhydride ester or hemi ester or hydroxylated derivative of such ester or hemi ester and (b) linear or branched alkyl or alkenyl substituted succinimides, succinamides or mixtures thereof or amino substituted succinimides, succinamides or mixtures thereof wherein said succinimides, succinamides or mixtures thereof is HITEC 536, MOBILAD C-603 or mixtures thereof, the formulation produced by addition of component (a) being characterized by the absence of pyridine derivatives of the formula

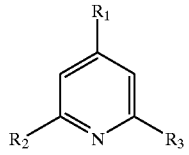

wherein $R_1$, $R_2$, $R_3$ are individually an alkyl group containing from 1 to 3 carbons.

5. A method for enhancing the corrosion inhibiting capacity of turbine oil composition comprising adding to a synthetic ester oil base stock a minor amount of corrosion inhibiting additive wherein said corrosion inhibiting additive comprises a combination of as a first component one or more $C_6$–$C_{40}$ dicarboxylic acid in an amount in the range of 100 to 1000 ppm, and a second component selected from (a) linear or branched alkyl or alkenyl succinic acid/anhydride ester or hemi ester or hydroxylated derivatives of such ester or hemi ester is of the formula:

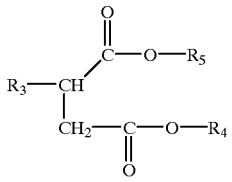

wherein $R_3$ is a $C_8$–$C_{16}$ linear or branched alkyl or alkenyl, $R_4$ and $R_5$ are different and are hydrogen, $C_1$–$C_4$ alkyl, $C_2$–$C_4$ alkenyl or:

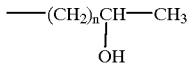

where n can be an integer from zero to five;

(b) linear or branched alkyl or alkenyl substituted succinimide or succinamide or amine substituted succinimide or succinamide of the formula:

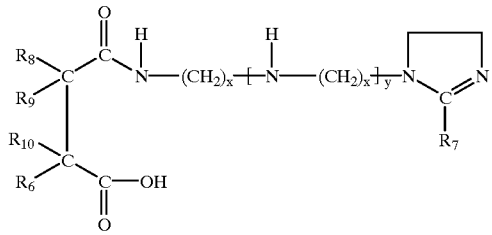

or

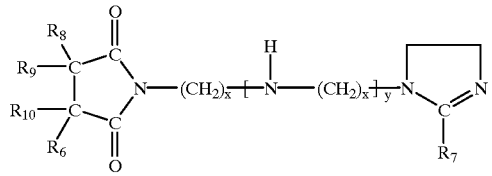

and mixtures thereof, wherein $R_6$, $R_8$, $R_9$, and $R_{10}$ are the same or different and are H or a $C_1$–$C_{16}$ linear or branched alkyl or alkenyl wherein at least one of $R_6$, $R_8$, $R_9$, and $R_{10}$ is hydrocarbyl, and $R_7$ is $C_8$–$C_{20}$ linear or branched alkyl or alkenyl, x is 2 to 10 and y is 0 or 1, said second component being present in turbine oil composition in an amount in the range of 100 to 1000 ppm, the formulation produced by addition of component (a) being characterized by the absence of pyridine derivatives of the formula

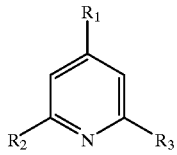

wherein $R_1$, $R_2$, $R_3$ are individually an alkyl group containing from 1 to 3 carbons.

6. The method of claim 4 or 5 wherein the dicarboxylic acid is selected from dioleic acid, sebacic acid, azelaic acid and mixtures thereof.

* * * * *